US007472896B1

(12) United States Patent
Tsai

(10) Patent No.: US 7,472,896 B1
(45) Date of Patent: Jan. 6, 2009

(54) HEATING AND HUMIDIFYING DEVICE

(76) Inventor: Hua-Hsin Tsai, No. 105, Jhongyang Rd., Jioucyong Village, Linnei Township, Yunlin County (TW)

( * ) Notice: Subject to any disclaimer, the term of this patent is extended or adjusted under 35 U.S.C. 154(b) by 0 days.

(21) Appl. No.: 11/896,956

(22) Filed: Sep. 7, 2007

(51) Int. Cl.
*B01F 3/04* (2006.01)

(52) U.S. Cl. ..... 261/142; 261/156; 261/DIG. 65; 392/403; 392/405

(58) Field of Classification Search ..... 261/104, 261/107, 142, 147, 156, DIG. 65; 422/24, 422/121; 250/494.1, 495.1, 504 R; 392/403, 392/405

See application file for complete search history.

(56) References Cited

U.S. PATENT DOCUMENTS 3,982,095 A * 9/1976 Robinson ..... 392/403
3,990,441 A * 11/1976 Hoyt et al. ..... 128/200.18
4,288,396 A * 9/1981 Ottestad ..... 261/128
4,419,302 A * 12/1983 Nishino et al. ..... 261/142
4,532,088 A * 7/1985 Miller ..... 261/142
4,618,462 A * 10/1986 Fisher ..... 261/130
4,644,790 A * 2/1987 Mizoguchi ..... 73/293
4,753,758 A * 6/1988 Miller ..... 261/139
5,361,322 A * 11/1994 Glucksman ..... 392/405
6,244,576 B1 * 6/2001 Tsai ..... 261/141
6,874,771 B2 * 4/2005 Birdsell et al. ..... 261/131
6,962,329 B2 * 11/2005 Bachert ..... 261/27
2003/0116019 A1 * 6/2003 Torkaman ..... 95/226

FOREIGN PATENT DOCUMENTS

JP 54-98034 A * 8/1979 ..... 261/DIG. 65

* cited by examiner

*Primary Examiner*—Richard L Chiesa
(74) *Attorney, Agent, or Firm*—Rosenberg, Klein & Lee

(57) ABSTRACT

This invention relates to a heating and humidifying device in which a far infrared generation region and a heat exchange region are divided within a housing by a plurality of support frames. Several quartz outer tubes sealed at both ends of each tube are provided in the far infrared generation region. A quartz inner tube having a far infrared ray heater is provided within each quartz outer tube. A water supply inlet is provided on the side wall of each quartz outer tube, and a number of water vapor outlets are provided at the upper portion on the side wall of the quartz outer tube. The heat exchange region has a container provided at the bottom portion which is provided with a water charge port and several water discharge ports. Each water discharge port is communicated with the water supply inlet of the quartz outer tube by a communicating tube, and a micro-water-pipette is provided within each communicating tube. In this manner, the humidity in the ambient air can be increased and the ambient temperature can be raised rapidly so as to provide a comfortable living environment for human beings.

5 Claims, 3 Drawing Sheets

HEATING AND HUMIDIFYING DEVICE

BACKGROUND OF THE INVENTION

1. Field of the Invention

The present invention relates to a heating and humidifying device, particularly to a heating and humidifying device by which the humidity in the ambient air can be raised and the temperature in the ambient can be increased rapidly.

2. Brief Description of the Prior Art

Usually, regional climate on the earth is influenced by some factors such as the latitude of the geological location and the ocean proximity, such that some regions belong to continental climate, some oceanic climate, some very hot all year around, and some very cool all year long. However, most of regions have four seasons, some regions with longer summer while some regions with longer winter in distinction.

Generally, the winter in continental climate region is characterized by its bitter cold and dryness which contributes to the symptom of dry skin even skin cracking, and makes people feel uncomfortable. How to increase the room temperature and humidity in winter has been becoming a big issue all the time.

In view of the above fact, the inventor of the present invention provides a novel heating and humidifying device according to the abundant professional knowledge accumulated and practical manufacturing experience in the relevant field, so that a solution for the above problem can be highly expected.

SUMMARY OF THE INVENTION

This invention relates to a heating and humidifying device in which a far infrared generation region and a heat exchange region are divided within a housing by a plurality of support frames. Several quartz outer tubes sealed at both ends of each tube are juxtaposedly arranged in the far infrared generation region. A quartz inner tube provided with a far infrared ray heater is provided within each quartz outer tube. One end of the quartz inner tube is provided with an electrode terminal which extends to the outside of the quartz outer tube. Furthermore, a water supply inlet is provided on the side wall of each quartz outer tube near the bottom end, and a number of water vapor outlets are provided at the upper portion on the side wall of the quartz outer tube. The heat exchange region has a water container provided at the bottom portion which is provided with a water charge port and several water discharge ports. Each water discharge port is communicated with the water supply inlet of the quartz outer tube by a communicating tube, and a micro-water-supply unit is provided within each communicating tube. The micro-water-supply unit has a siphon material or a one-way check valve provided within each communicating tube. A plurality of moistured air discharge ports are provided on the top surface of the heat exchange region. In this manner, the humidity in the ambient air can be increased and the ambient temperature can be raised rapidly so as to provide a comfortable living environment for human beings.

BRIEF DESCRIPTION OF THE DRAWINGS

The present invention will be better understood by the detailed description of the following preferred embodiments with reference to the accompanying drawings, in which.

DETAILED DESCRIPTION OF THE PREFERRED EMBODIMENTS

The objects, the technical contents and the expected effectiveness of the present invention will become more apparent from the detailed description of the preferred embodiment in conjunction with the accompanying drawings.

Figure 1:
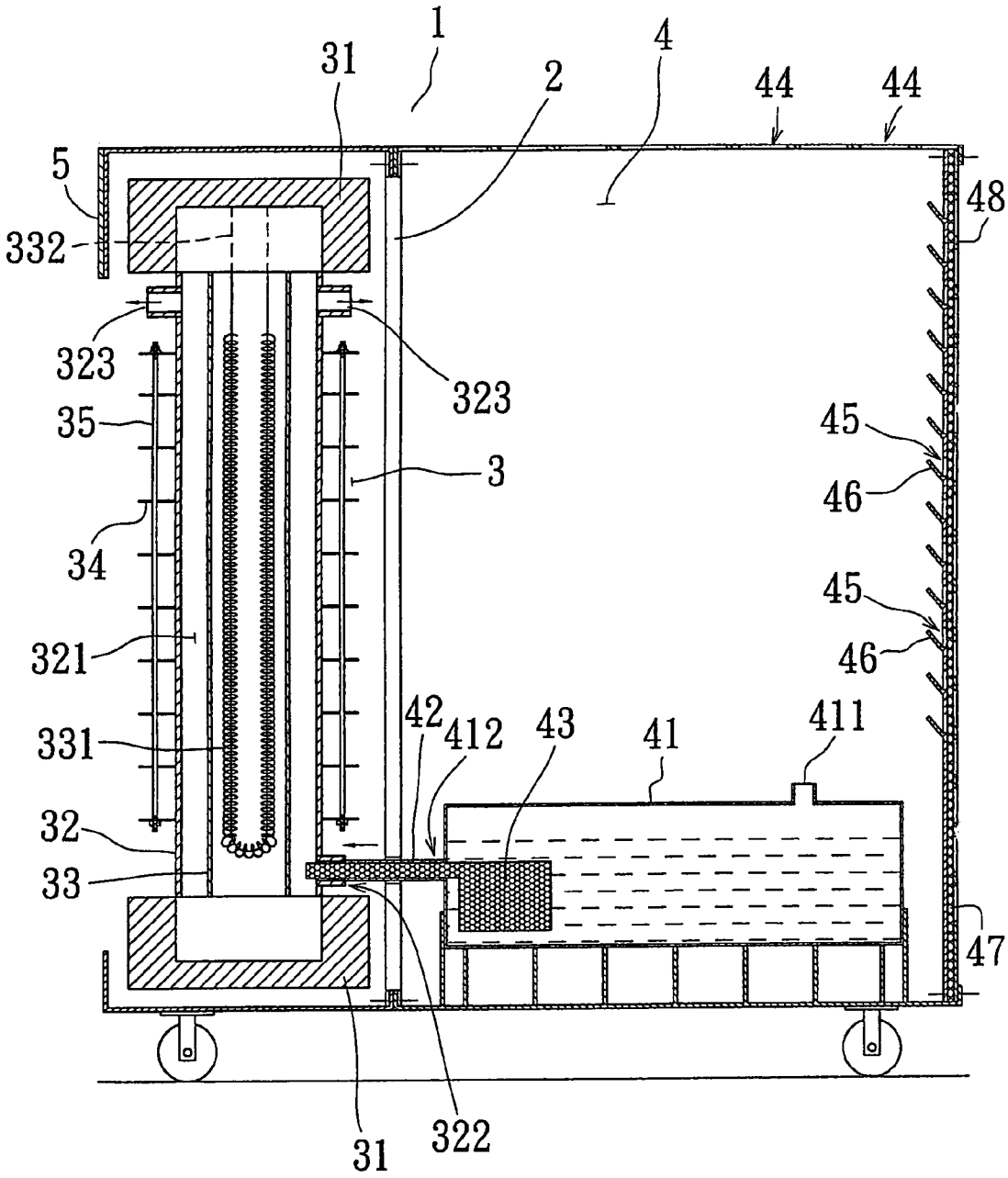
FIG. 1 is a side sectional view showing the heating and humidifying device of the present invention.
Figure 2:
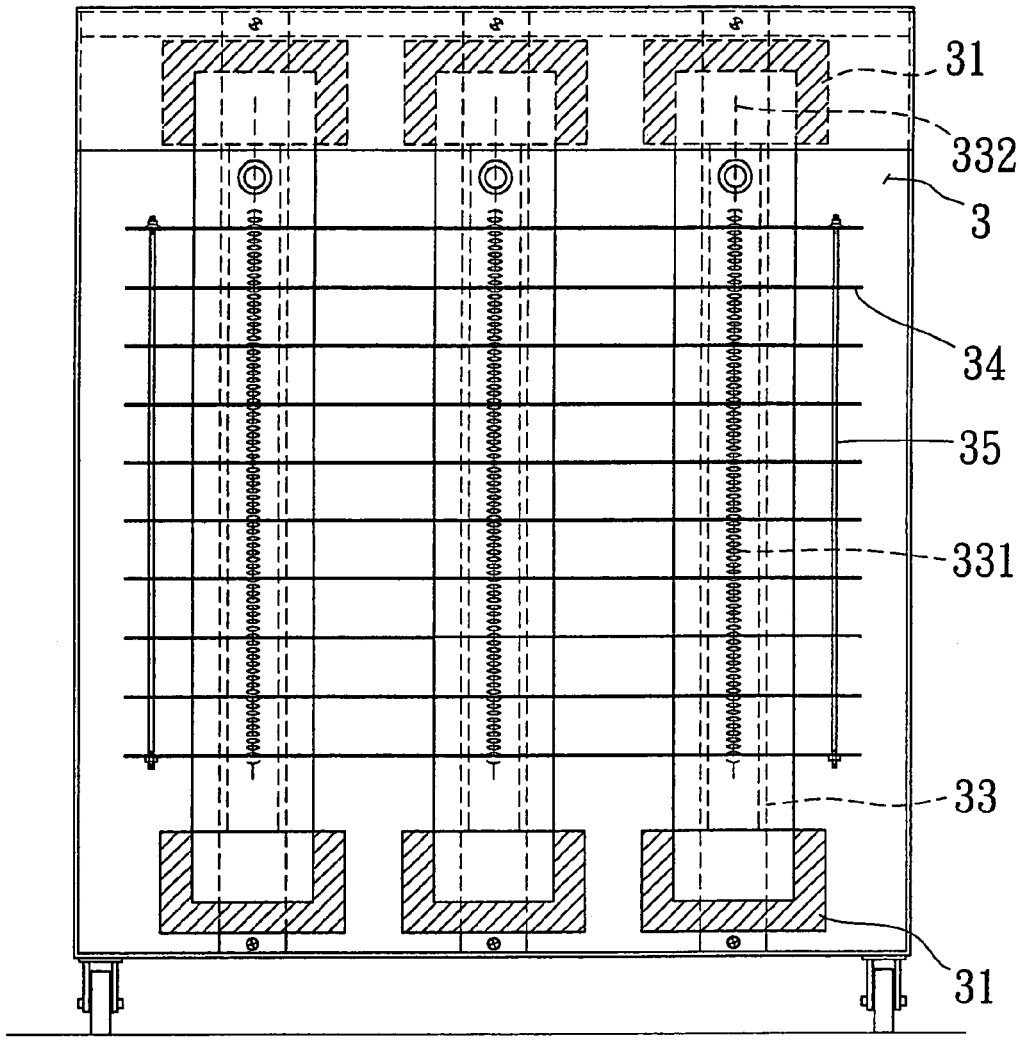
FIG. 2 is a front sectional view showing the heating and humidifying device of the present invention.
Figure 3:
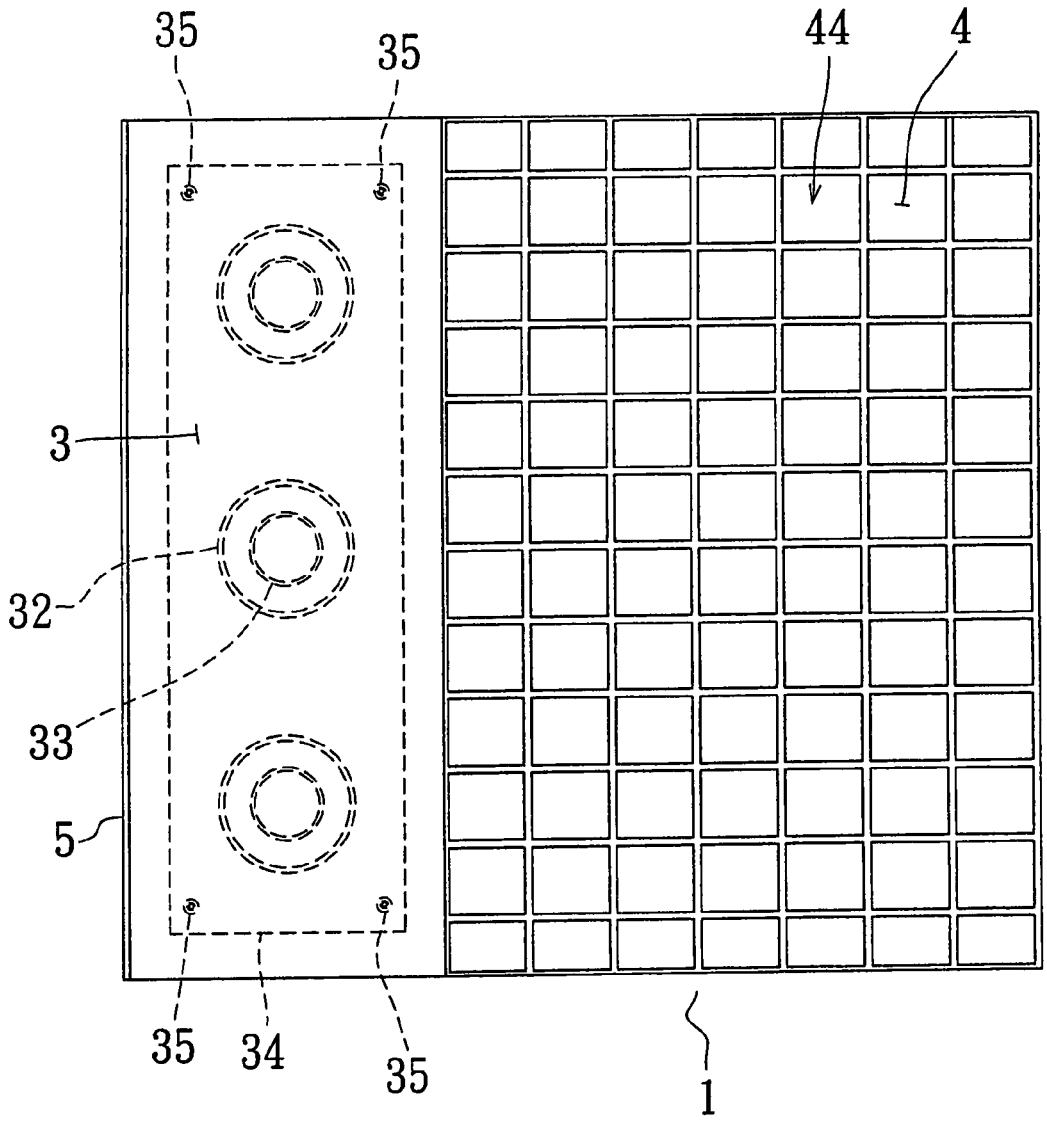
FIG. 3 is a top sectional view showing the heating and humidifying device of the present invention.

Firstly referring to FIGS. 1, 2 and 3, wherein FIG. 1 is a side sectional view; FIG. 2 is a front sectional view; and FIG. 3 is a top sectional view showing the heating and humidifying device of the present invention. The heating and humidifying device (1) of the present invention mainly comprises a far infrared generation region (3) and a heat exchange region (4) divided within a housing (1) by a plurality of support frame (2), the far infrared ray produced in the far infrared generation region (3) and the water vapor can enter into the heat exchange region (4) directly and drained naturally after mixing with ordinary air. A mounting seat (31) is provided respectively at the upper and the lower end of the far infrared generation region (3). Several quartz outer tubes (32) sealed at both ends of each tube are juxtaposedly arranged in the far infrared generation region (3). Each quartz outer tube (32) is provided with a quartz inner tube (33) therein, and a far infrared ray heater (331) preferably made by carbon fiber is mounted inside each quartz inner tube (33). One end of each quartz inner tube (33) is provided with an electrode terminal (332) through which electric current flows to the far infrared ray heater (331) to produce far infrared ray and heat. Both ends of the quartz outer tube (32) are combined with the quartz inner tube (33) by hot pressing. The electrode terminal (332) of the inner quartz tube (33) is extended to the outside of the outer quartz tube (32), and an accommodation space (321) is formed between the outer quartz tube (32) and the inner quartz tube (33). Furthermore, a water supply inlet (322) is provided on the side wall of each quartz outer tube (32) near the bottom end, and a number of water vapor outlets (323) are provided on the side wall of each quartz outer tube (32) at the upper end. The water vapor outlets (323) are oriented to the heat exchange region (4) so that the water vapor can be drained into the heat exchange region (4). A plurality of heat dissipating fins (34) protruding vertically from the outside surface of the quartz outer tube (32) and arranged in spaced relationship with each other are inserted around the circumference of the quartz outer tube (32). Four tautening elements (35) are used to strain the four corners of the plural heat dissipating fins (34) so as to maintain the spaced relationship with each other and to combine all the heat dissipating fins together. Each heat dissipating fin (34) is combined with the quartz outer tube (32) by spot welding.

The heat exchange region (4) has a water container (41) provided at the bottom portion, a water charge port (411) is provided on the top of the water container (41) for water charging. A water discharge port (412) associated with each quartz outer tube (32) is provided on one side of the water container (41) with respect to the far infrared generation region (3). Each water discharge port (412) is communicated with the water supply inlet (322) of the associated quartz outer tube (32) by a communicating tube (42). A micro-water-supply unit (43) is provided within each communicating tube (42). The micro-water-supply unit (43) has a siphon material, preferable a ceramic material, extended to the bottom portion of the water container (41) such that the water in the water container (41) can be siphoned gradually and dripped into the inside of the quartz outer tube (32) according to the principle of siphon. Alternatively, the micro-water-supply unit (43) has a one-way check valve provided within each communicating tube (42), which controls the water in the water container (41) dripped in microlevel quantity into the inside of the quartz outer tube (32) gradually. A plurality of moistured air discharge ports (44) are provided on the top surface of the heat exchange region (4). In addition, a plurality of air intake ports (45) are provided on the other side wall of the heat exchange region (4) with respect to the far infrared generation region (3), and a plurality of light reflecting surface (46) are provided on the inner side wall of said other side, which can reflect the far infrared ray generated in the far infrared generation region (3) into the heat exchange region (4). An air filter (47) and a permeable guard panel (48) can be provided in order on the outside of said other side wall, such that the air outside the housing (1) enters into the heat exchange region (4) therethrough.

In the operation, as shown in FIGS. 1~3, the switch on the control panel (5) of the housing (1) is activated such that the electrode terminal (332) of the inner quartz tube (33) is electrically connected with power source. Thus, the far infrared ray produced by the far infrared ray heater (331) within the quartz inner tube (33) is irradiated to generate heat. The far infrared ray irradiated to the heat exchange region (4) is further concentrated by the reflection on the light reflection surface (46) provided at said other side wall of the heat exchange region (4), so that the temperature in the heat exchange region (4) rises. Furthermore, the water in the water container (41) is dripped gradually in microlevel quantity into the accommodation space (321) between the quartz outer tube (32) and the quartz inner tube (33) by the micro-water-supply unit (43) provided within each communicating tube (42), through the water discharge port (412) of the water container (41) in the heat exchange region (4) connected to the water supply inlet (322) of the associated quartz outer tube (32). At this moment, the water dripped into the quartz outer tube (32) is heated to high temperature by means of the highly concentrated heat irradiated from the far infrared ray heater (331) within the quartz inner tube (33) and is boiled and thus vaporized immediately. The water vapor thus produced is dispersed into the air within the far infrared generation region (3), or into the heat exchange region (4) to mix with the air inside. Thus, the mixture of the water vapor and air is diffused to the ambient through the moistured air discharge ports (44) on the top of the heat exchange region.

Summing up above, from the description of the configuration and the embodiments, the present invention has the advantages as follow:

1. the heating and humidifying device of the present invention is provided with a far infrared ray heater in each inner quartz tube for producing far infrared ray which is capable of raising the ambient temperature rapidly without rendering negative influence on human body.
2. as described above, the heating and humidifying device of the present invention is provided with far infrared ray heaters in each inner quartz tube for producing heat which causes a rise in temperature inside the outer quartz tube. The water in the water container is dripped gradually in microlevel quantity into the accommodation space between the quartz outer tube and the quartz inner tube by the micro water-supply unit provided within each communicating tube, through the water discharge port of the water container in the heat exchange region connected to the water supply inlet of the associated quartz outer tube. As the far infrared ray heater within the quartz inner tube heats the water to relatively high temperature, the water dripped into the quartz outer tube is boiled and thus vaporized immediately and is diffused to the ambient through the moistured air discharge ports on the top of the heat exchange region. In this way, the increase in both the humidity and the temperature of the ambient air can be accelerated.

Based on foregoing, the heating and humidifying device depicted by the preferred embodiment of this invention can reach expected effectiveness, and the specific configurations disclosed herein have yet been seen in the prior art of the same category of product.

While the present invention has been described with preferred embodiment in conjunction with the accompanying drawings, it is noted that the preferred embodiment and the drawings are purely for the convenience of description only, not intended to be restrictive on the scope of the present invention. Any modifications and variations or the equivalents developed without departing from the spirit of the present invention is considered to be still within the scope of the present invention.

What is claimed is:

1. A heating and humidifying device, wherein a far infrared generation region (3) and a heat exchange region (4) are divided within a housing by a plurality of support frames, in said far infrared generation region (3):

mounting seats (31) being provided respectively at the upper and the lower ends thereof, several quartz outer tubes (32) sealed at both ends of each tube being juxtaposedly arranged in the far infrared generation region (3), a quartz inner tube (33) having a far infrared ray heater (331) inside being provided within each said quartz outer tube (32), one end of each said quartz inner tube (33) being provided with an electrode terminal (332) which extends to the outside of each associated said quartz outer tube (32), a water supply inlet (322) being provided on the side wall of each said quartz outer tube (32) near the bottom end, and a number of water vapor outlets (323) being provided on the side wall of each said quartz outer tube (32) at the upper end, in said heat exchange region (4):

a water container (41) being provided at the bottom portion thereof, which is provided with a water charge port (411) and a plurality of water discharge ports (412), each water discharge port (412) being communicated with the water supply inlet (322) of the associated said quartz outer tube (32) by a communicating tube (42), a micro-water-supply unit (43) being provided within each said communicating tube (42), a plurality of moistured air discharge ports (44) being provided on the top surface of the heat exchange region (4), and a plurality of air intake ports (45) being provided on the side wall of the heat exchange region (4).

2. A heating and humidifying device in accordance with claim 1, wherein a plurality of heat dissipating fins (34) protruding vertically from the outside surface of the quartz outer tube (32) and arranged in spaced relationship with each other are inserted around the circumference of the quartz outer tube (32), and four tautening elements (35) are used to strain the four corners of the plural heat dissipating fins (34) so as to maintain the spaced relationship with each other and to combine all the heat dissipating fins together.

3. A heating and humidifying device in accordance with claim 1, wherein the micro water-supply unit (43) has a ceramic material which is extended to the bottom portion of the water container (41).

4. A heating and humidifying device in accordance with claim 1, wherein the micro water-supply unit (43) has a one-way check valve provided within each said communicating tube (42).

5. A heating and humidifying device in accordance with claim 1, wherein a plurality of air intake ports (45) are provided on the other side wall of the heat exchange region (4) with respect to the far infrared generation region (3), and a plurality of light reflecting surfaces (46) are provided on the inner side wall of said other side, an air filter (47) and a permeable guard panel (48) can be provided in order at the outside of said other side wall.

* * * * *